US011974598B2

(12) United States Patent
Sutton

(10) Patent No.: US 11,974,598 B2
(45) **Date of Patent: *May 7, 2024**

(54) FILTER UNIT FOR ELECTRONIC CIGARETTES

(71) Applicant: Isaac Sutton, Brooklyn, NY (US)

(72) Inventor: Isaac Sutton, Brooklyn, NY (US)

(73) Assignee: Isaac Sutton, Brooklyn, NY (US)

( * ) Notice: Subject to any disclaimer, the term of this patent is extended or adjusted under 35 U.S.C. 154(b) by 91 days.

This patent is subject to a terminal disclaimer.

(21) Appl. No.: 17/493,307

(22) Filed: Oct. 4, 2021

(65) Prior Publication Data

US 2022/0022530 A1 Jan. 27, 2022

Related U.S. Application Data

(63) Continuation of application No. 16/544,978, filed on Aug. 20, 2019, now Pat. No. 11,166,489.

(51) Int. Cl.
*A24D 3/10* (2006.01)

(52) U.S. Cl.
CPC ..... *A24D 3/10* (2013.01)

(58) Field of Classification Search
CPC ..... A24D 3/10; A24D 3/17
See application file for complete search history.

(56) References Cited

U.S. PATENT DOCUMENTS 6,257,252 B1 7/2001 Hall
6,345,625 B1 2/2002 Chew
2013/0276803 A1 10/2013 Saito et al.
2015/0013692 A1 1/2015 Liu
2016/0021929 A1 1/2016 Sawalha
2018/0352856 A1* 12/2018 Sebastian ..... A24D 3/17
2019/0029319 A1* 1/2019 Moorman ..... A24F 9/02
(Continued)

FOREIGN PATENT DOCUMENTS

CN 204180931 U 3/2015
CN 104770879 A 7/2015
(Continued)

OTHER PUBLICATIONS

Philter Labs, *How Will Filtering Your Vape Improve Your Vaping Experience*? [retrieved from Internet Oct. 11, 2021] <[https://philterlabs.com/blogs/news/how-will-filtering-your-vape-improve-your-vaping-experience>.
(Continued)

*Primary Examiner* — Christopher M Rodd
*Assistant Examiner* — Jennifer A Kessie
(74) *Attorney, Agent, or Firm* — Alston & Bird LLP

(57) ABSTRACT

A filtering unit for use with an electronic cigarette which includes a hollo housing and a filter pad located inside the housing. The housing has a first end, a second end, a front wall, and a rear wall. The front wall and the rear wall extend from the first end to the second end of the housing. The hollow housing also including a throughgoing opening formed at the second end and at least one pair of first internally extending prongs, these first prongs forming an internal chamber. The filter pad is positioned inside the internal chamber of the hollow housing. The second end of the hollow chamber is positionable over a portion of the electronic cigarette so as to filter out undesired particles in vapors of the electronic cigarette.

20 Claims, 14 Drawing Sheets

(56) References Cited

U.S. PATENT DOCUMENTS

| | | | |
|---|---|---|---|
| 2019/0124974 | A1 | 5/2019 | Dimmick et al. |
| 2019/0320723 | A1 | 10/2019 | Sebastian et al. |

FOREIGN PATENT DOCUMENTS

| | | | |
|---|---|---|---|
| CN | 205030517 | U | 2/2016 |
| CN | 106136314 | A | 11/2016 |
| CN | 106376978 | A | 2/2017 |
| CN | 208692317 | U | 4/2019 |
| CN | 208850678 | U | 5/2019 |
| JP | H-1033155 | A | 2/1998 |
| KR | 200481588 | Y1 | 10/2016 |
| KR | 20190031784 | A | 3/2019 |
| WO | WO-2003/086116 | A1 | 10/2003 |
| WO | WO-2015/188296 | A1 | 12/2015 |
| WO | WO-2016/079729 | A1 | 5/2016 |
| WO | WO-2017/210967 | A1 | 12/2017 |
| WO | WO-2019/084830 | A1 | 5/2019 |
| WO | WO-2019/169652 | A1 | 9/2019 |

OTHER PUBLICATIONS

Walmart, One Step at a Time Nicotine Addition Withdrawal System 1 Pack—Contains 4 Re-useable filters [retrieved from Internet Oct. 11, 2021] <https://www.walmart.com/ip/ONE-STEP-AT-A-TIME-NICOTINE-ADDICTION-WITHDRAWAL-SYSTEM-1-PACK-Contains-4-Re-usable-filters/151972087>.

Amazon, Nic-Out Cigarette Filters Holders Stope Smoking Aid Reduce Tar and Nicotine [retrieved from Internet Oct. 11, 2021] <https://www.amazon.com/Cigarette-Filters-Holders-Smoking-Nicotine/dp/B009CJ98BC>.

BUSHPLANET—Active Charcoal Filter [retrieved from Internet Oct. 11, 2021] <https://shop.bushplanet.com/Active-Charcoal-Filter> (9 pages).

National Institute on Drug Abuse, Research 17 Monograph Series—Research on Smoking Behavior [retrieved from Internet Oct. 11, 2021] <https://web.archive.org/web/20150723034328/http://archives.drugabuse.gov/pdf/monographs/17.pdf> (397 pages).

NCBI Bookshelf, Clearing the Smoke: Assessing the Science Base for Tobacco Harm Reduction [retrieved from Internet Oct. 11, 2021] <https://www.ncbi.nlm.nih.gov/books/NBK222363/ (45 pages).

MacArthur, Sam, *Vaping: The Good, the Bad and the Popcorn Lung*, MPHonline [retrieved from Internet Oct. 11, 202] <https://www.mphonline.org/vaping-public-health/> (14 pages).

Neulabs, *Quitting Cigarettes Gadgets to the Rescue*, Inspired Magazine, [retrieved from Internet Oct. 11, 2021] <https://inspiredmagz.com/quitting-cigarettes-gadgets-to-the-rescue/> (4 pages).

Chapter 4: Management of Nicotine Addition [retrieved from Internet Oct. 11, 2021] <https://www.cdc.gov/tobacco/data_statistics/sgr/2000/complete_report/pdfs/chapter4.pdf> (62 pages).

McGovern, P.G. et al., *Reduced nicotine exposure and abstinence outcome in two nicotine fading methods*, NIH, National Library of Medicine (Abstract) [retrieved from Internet Oct. 11, 2021] <https://www.ncbi.nlm.nih.gov/pubmed/2048454> (1 page).

* cited by examiner

FILTER UNIT FOR ELECTRONIC CIGARETTES

CROSS-REFERENCE TO RELATED APPLICATIONS

This application is a continuation of U.S. application Ser. No. 16/544,978, filed Aug. 20, 2019, the disclosure of which is herein incorporated by reference in its entirety.

BACKGROUND OF THE INVENTION

This application and its disclosure generally relate to the field of electronic cigarettes.

Vaping, aka smoking e-cigarettes, is a trend that's skyrocketed in popularity over the last few years, especially among teenagers, for whom e-cigarettes are actually illegal. Regular cigarettes burn tobacco, creating a smoke that the user inhales. E-cigarettes, on the other hand, don't burn anything. The technology consists of a small coil wrapped around a wick. The apparatus is soaked in a liquid, usually propylene glycol, vegetable glycerin, flavorants, and nicotine. Heating the coil around the saturated wick creates a vapor of ultrafine particles, including nicotine, which users breathe into their lungs. Both cigarettes and e-cigarettes generate aerosols of ultrafine particles in order to give its users a hard nicotine hit. Further, according to some studies, flavored ingredients in some electronic cigarettes combust to create toxic chemicals that are not listed on the label and could cause lung damage. Therefore, it is desirable to provide a filtering mechanism for filtering out the undesired particles and toxic chemicals.

Some e-cigarettes incorporate internal filtering. However, none of the existing e-cigarettes offer a separate filtering unit, which can be selectively attached to the e-cigarette to filter out undesired particles and toxic chemicals.

SUMMARY OF THE INVENTION

In its general aspect, the apparatus is a filtering unit for use with an electronic cigarette that includes a hollow housing and a filter pad located inside the housing. The housing has a first end, a second end, a front wall, and a rear wall. The front wall and the rear wall extend from the first end to the second end of the housing. The hollow housing also including a throughgoing opening formed at the second end and at least one pair of first internally extending prongs, these first prongs forming an internal chamber. The filter pad is positioned inside the internal chamber of the hollow housing. The second end of the hollow chamber is positionable over a portion of the electronic cigarette so as to filter out undesired particles in vapors of the electronic cigarette.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of examples which are not a limitation, and the figures of the accompanying drawings in which references denote corresponding parts, and in which.

DETAILED DESCRIPTION OF THE INVENTION

As illustrated in the attached Figures, the apparatus of the present invention is designed to attach to a conventional electronic cigarette and to filter out particles and chemicals before they are inhaled by the user.

Figure 1:
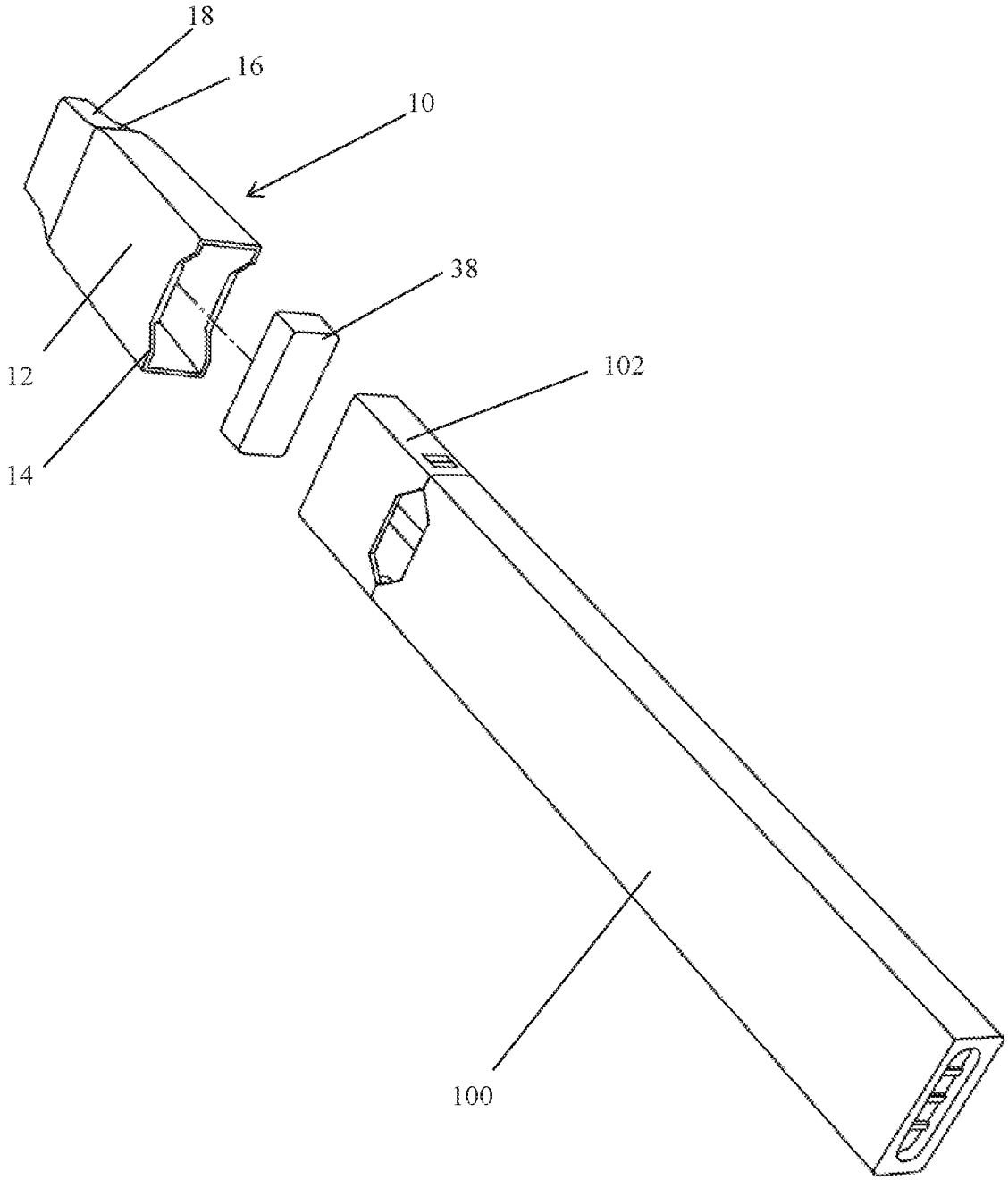
FIG. 1 is an exploded perspective view of a first type of electronic cigarette with a filtering unit of the present invention.
Figure 2:
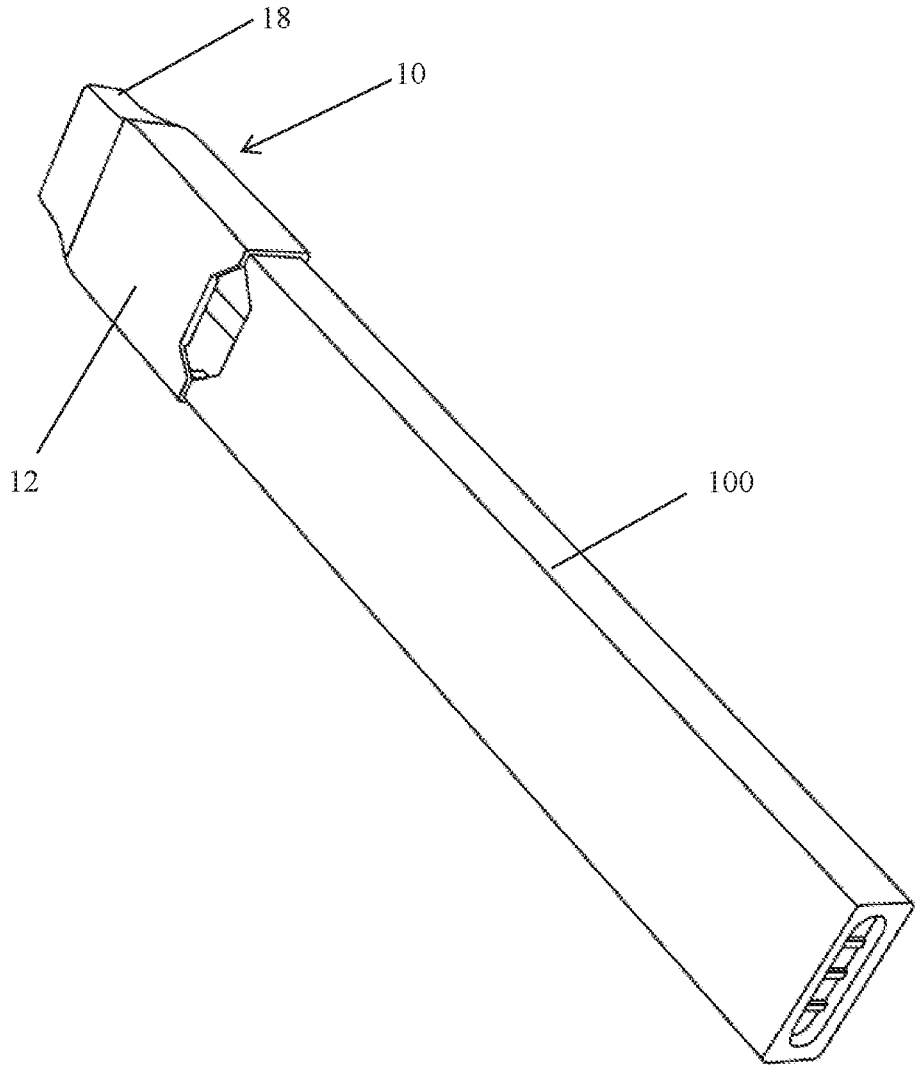
FIG. 2 is a perspective view of the assembled first type of electronic cigarette with the filtering unit of the present invention.
Figure 3:
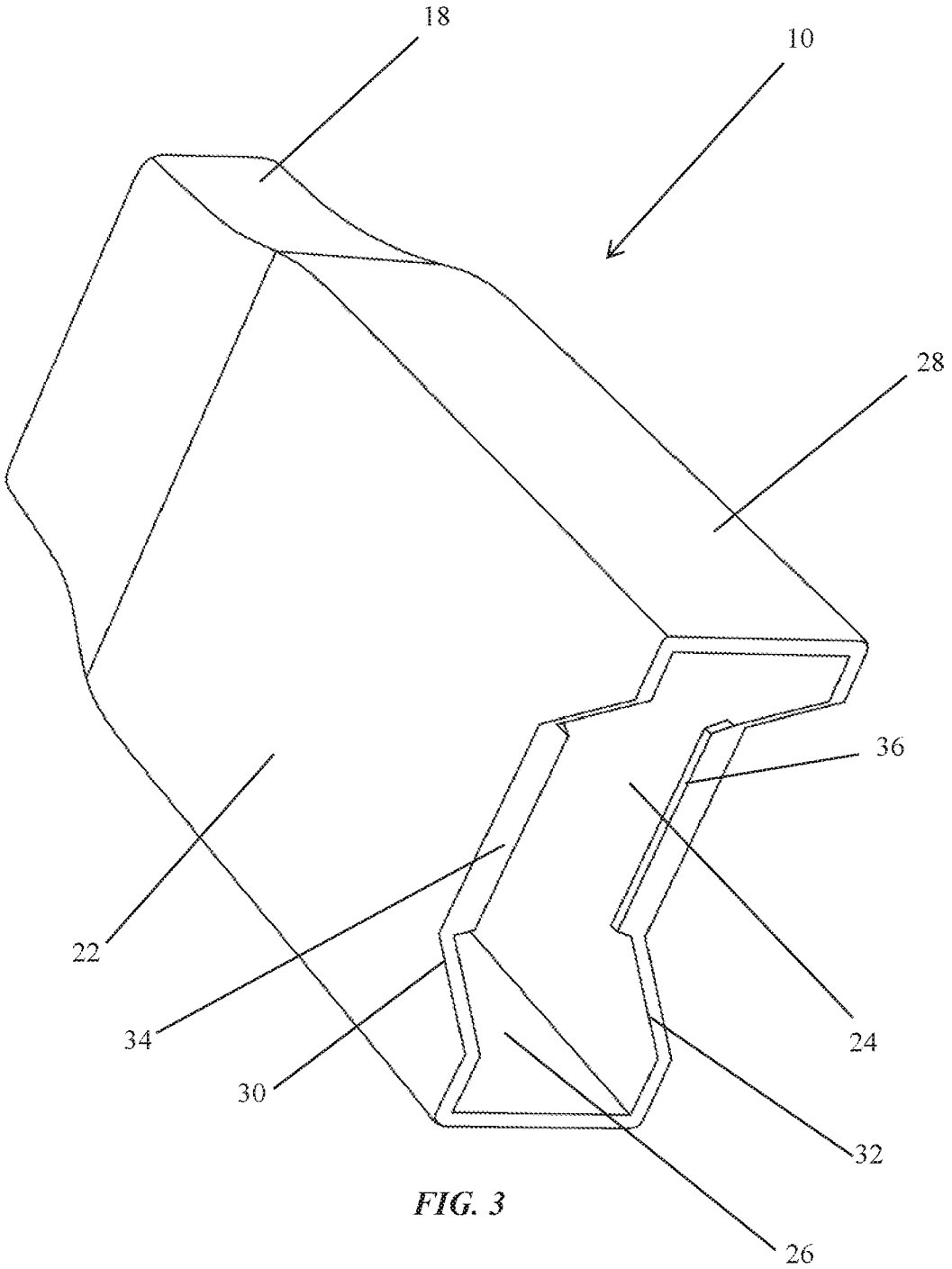
FIG. 3 is a perspective view of the filtering unit of the present invention.
Figure 4:
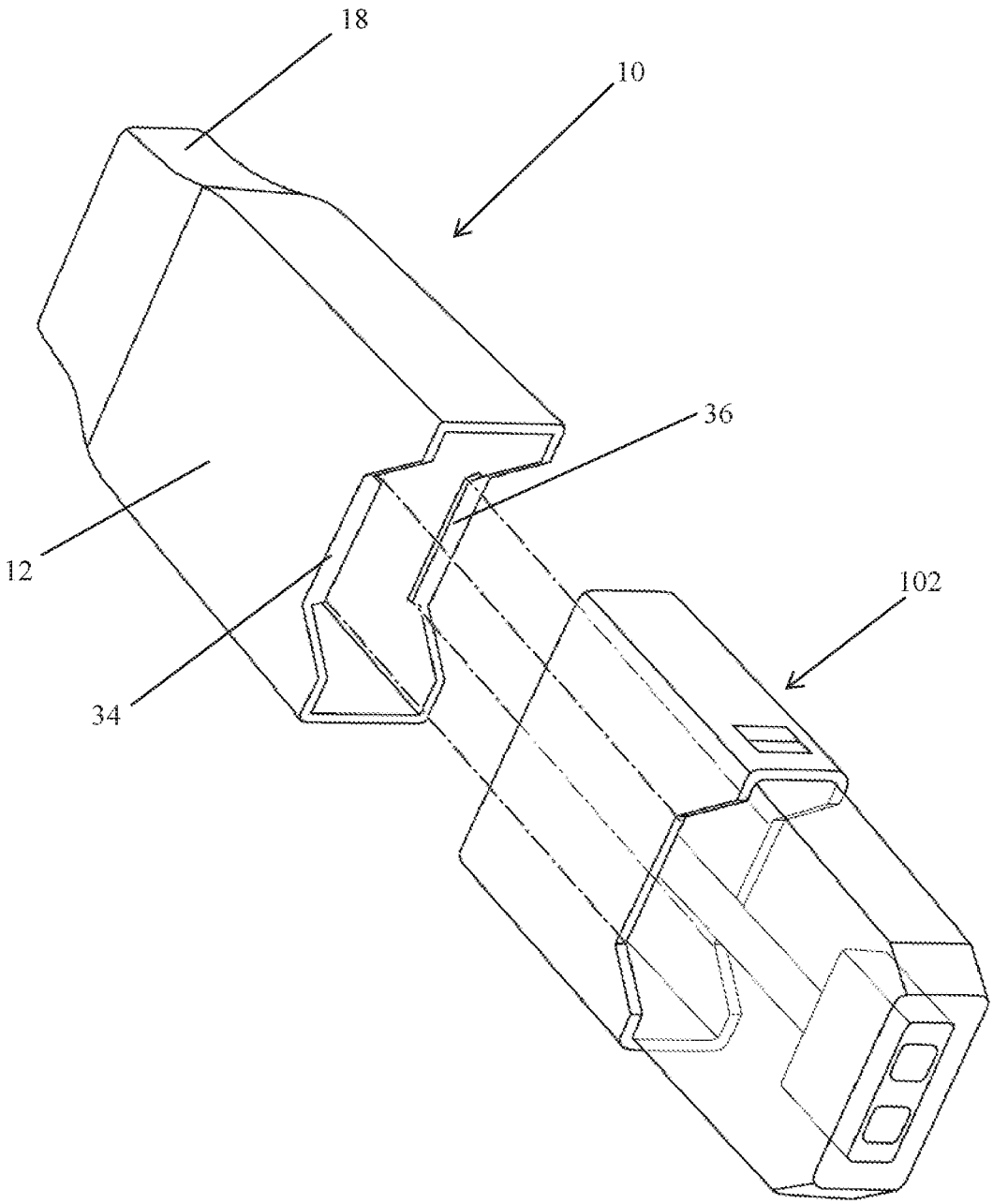
FIG. 4 is an exploded perspective view of a pod of the first type of electronic cigarette and the filtering unit of the present invention.
Figure 5:
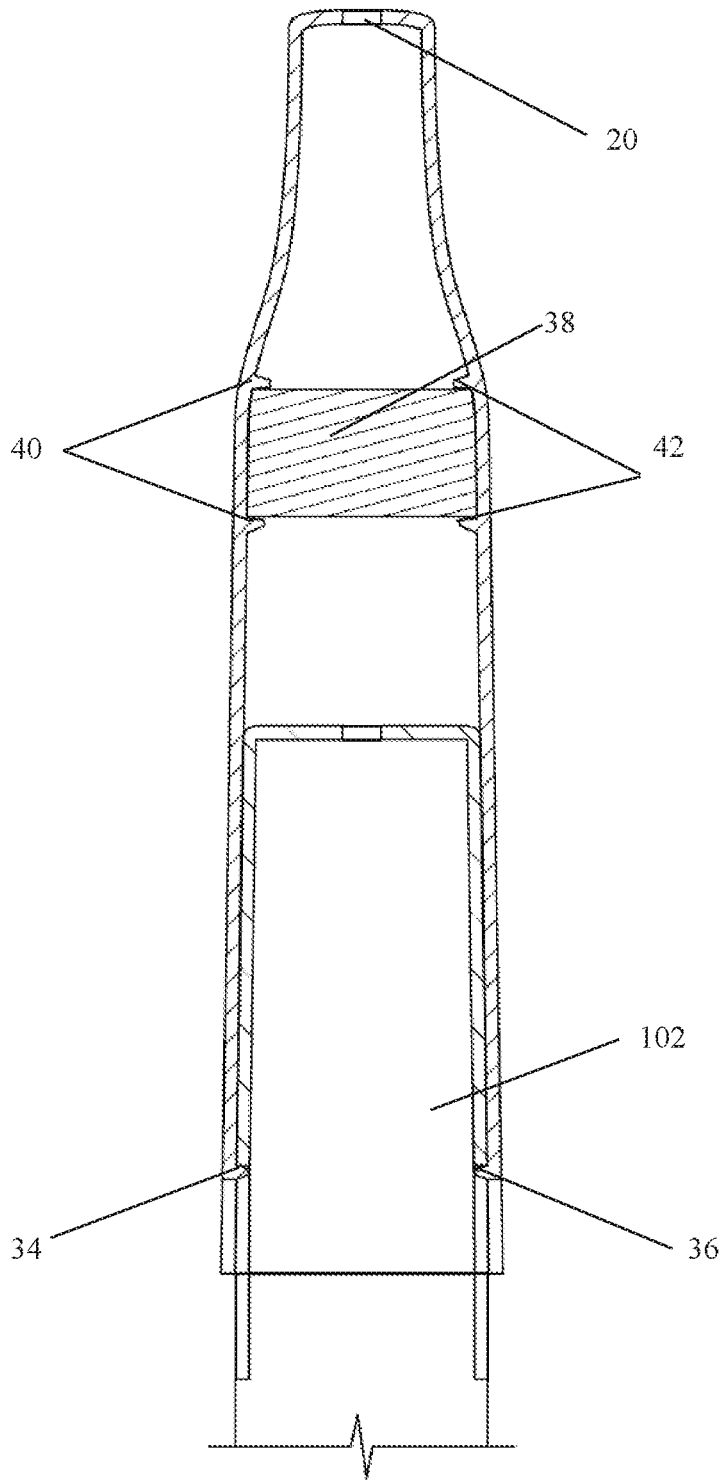
FIG. 5 is a cross-sectional view of the assembled first type of electronic cigarette with the filtering unit of the present invention.

As shown in FIG. 1, a typical electronic cigarette includes a charging unit 100 and a pod unit 102. In the preferred embodiment, illustrated in FIGS. 1-5, the filtering unit 10 is a relatively small unit having a hollow housing 12 with a first end 14 and a second end 16. A mouthpiece 18 is preferably formed at the second end 16. A throughgoing opening 20 (shown in detail in FIG. 5) is formed in the mouthpiece 18 allowing the vapors to pass from the pod unit 102 through the housing and into the user's mouth. The housing 12 also includes a front wall 22, rear wall 24 and two side walls 26 and 28, respectively. All walls of the housing 12 extend between the first end 14 and the second end 16. The front wall 22 and rear wall 24 preferably have notches 30 and 32, respectively, to better accommodate at least a portion of the pod unit 102. Further, each notch 30, 32 includes a prong 34, 36, respectively. As shown in FIGS. 2, 4 and 5, prongs 34 and 36 are designed and sized to securely attach to the upper portion of the pod unit 102, so as to securely mount the filtering unit 10 on the pod unit of the electronic cigarette. In the preferred embodiment, prongs 34 and 36 are designed so as to permanently and non-removably attach to the pod unit. However, prongs 34 and 36 can also be sized to enable the user to selectively remove the filtering unit 10 from the pod unit.

As shown in FIGS. 1 and 5, filtering unit 10 further includes a filter pad 38 placed inside the hollow interior of the housing 12. In the preferred embodiment, two pairs of internal prongs 40, 42 are formed on walls of the housing 12. Internal prong pairs 40 and 42 are spaced from each other so as to form an internal chamber sized to accommodate and hold therebetween the filter pad 38. In the preferred embodiment, filter pad 38 is made of treated cellulose acetate fiber. However, as will be apparent to a person skilled in the art, any other suitable filtering material can be utilized. Such other materials can be selected to filter out more particles and chemicals from the vapors. Further, more than one filtering pad can be utilized with the present invention for increased filtering.

Figure 8:
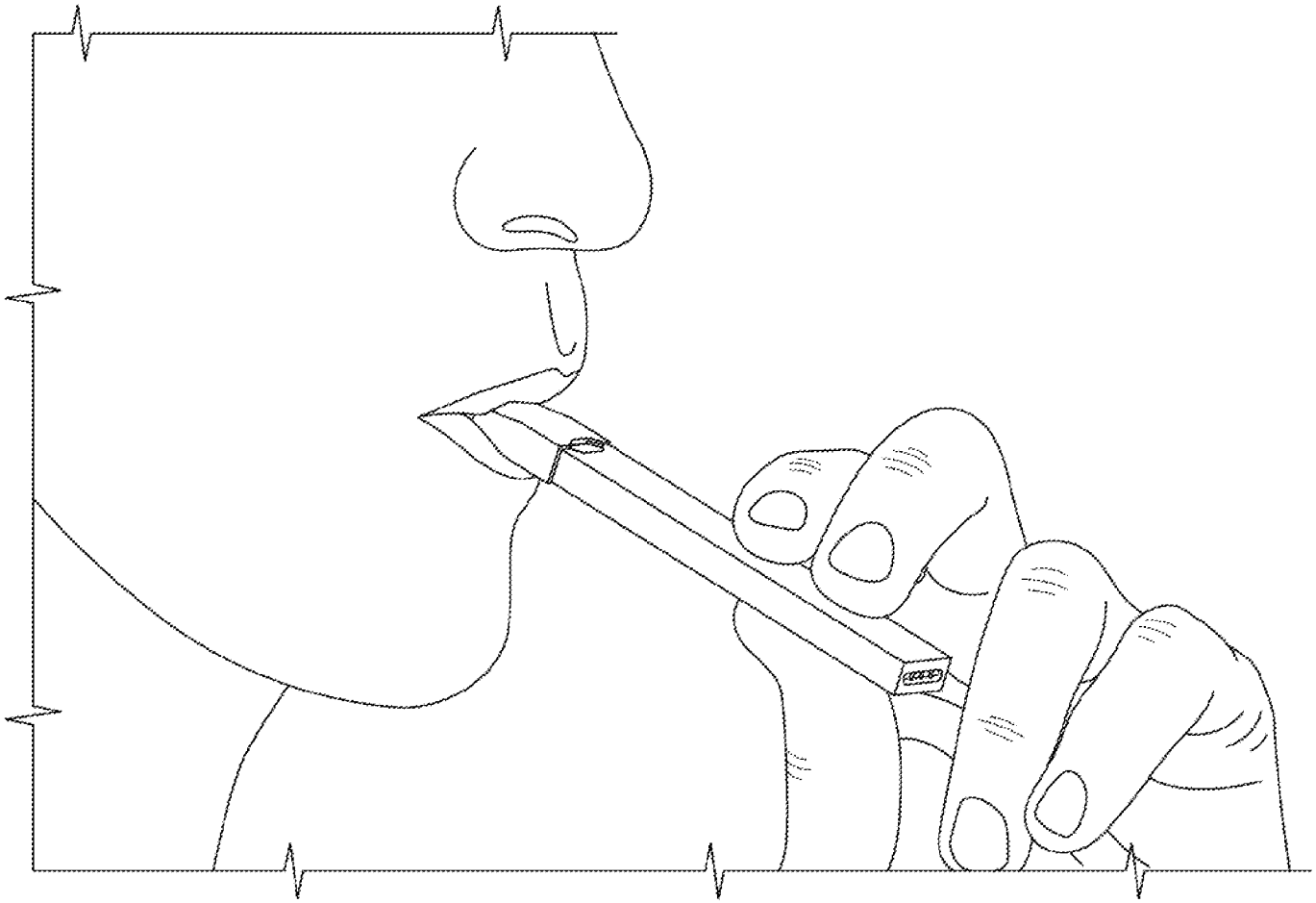
FIG. 8 is a view illustrating use of the first type of electronic cigarette with the filtering unit of the present invention.
Figure 9:
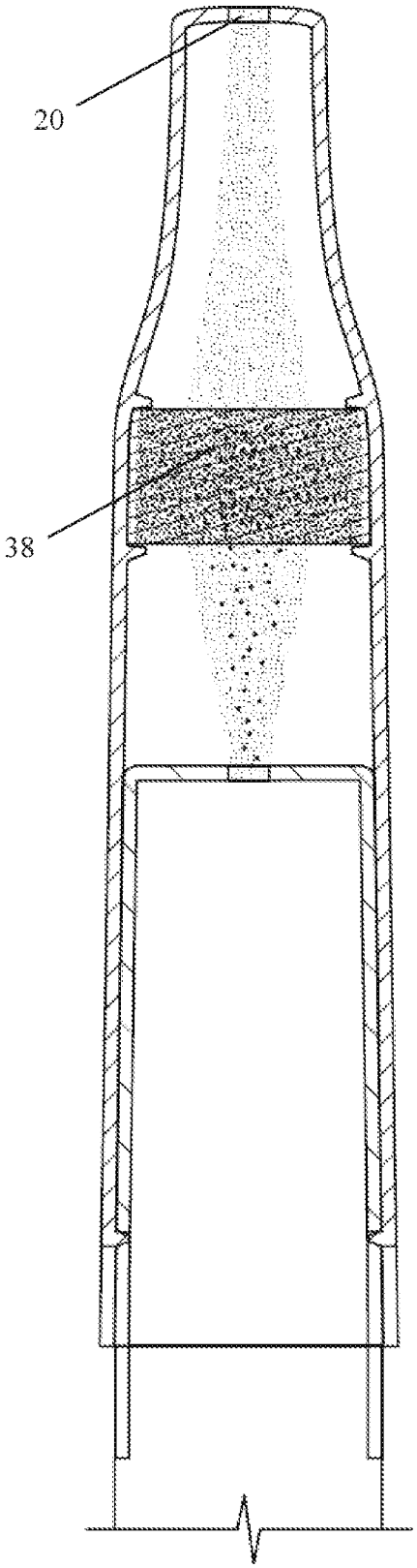
FIG. 9 is a cross-sectional view illustrating use of the first type of electronic cigarette with the filtering unit of the present invention.
Figure 10:
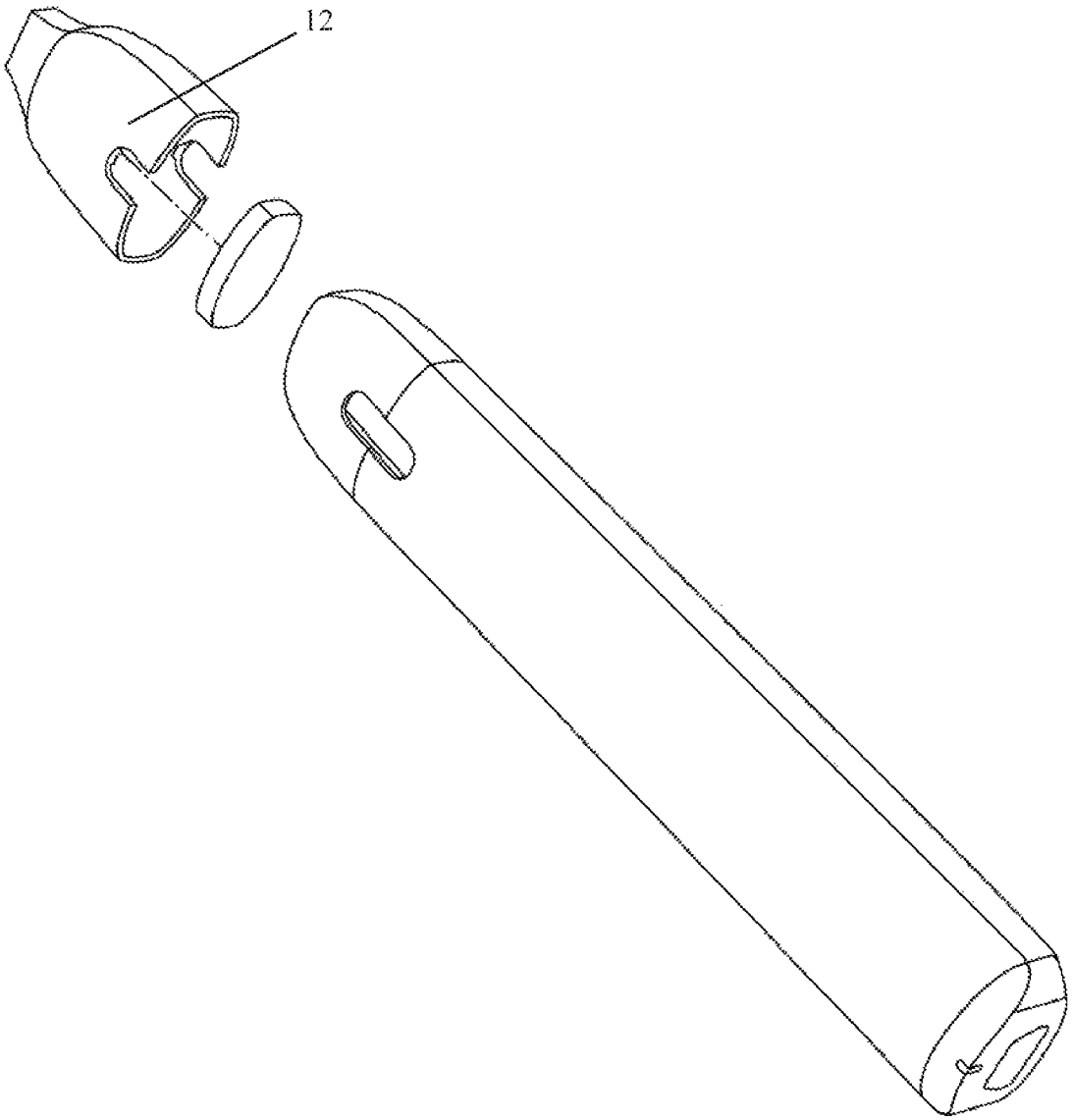
FIG. 10 is an exploded perspective view of a second type of electronic cigarette with a second alternative embodiment of the filtering unit of the present invention.
Figure 11:
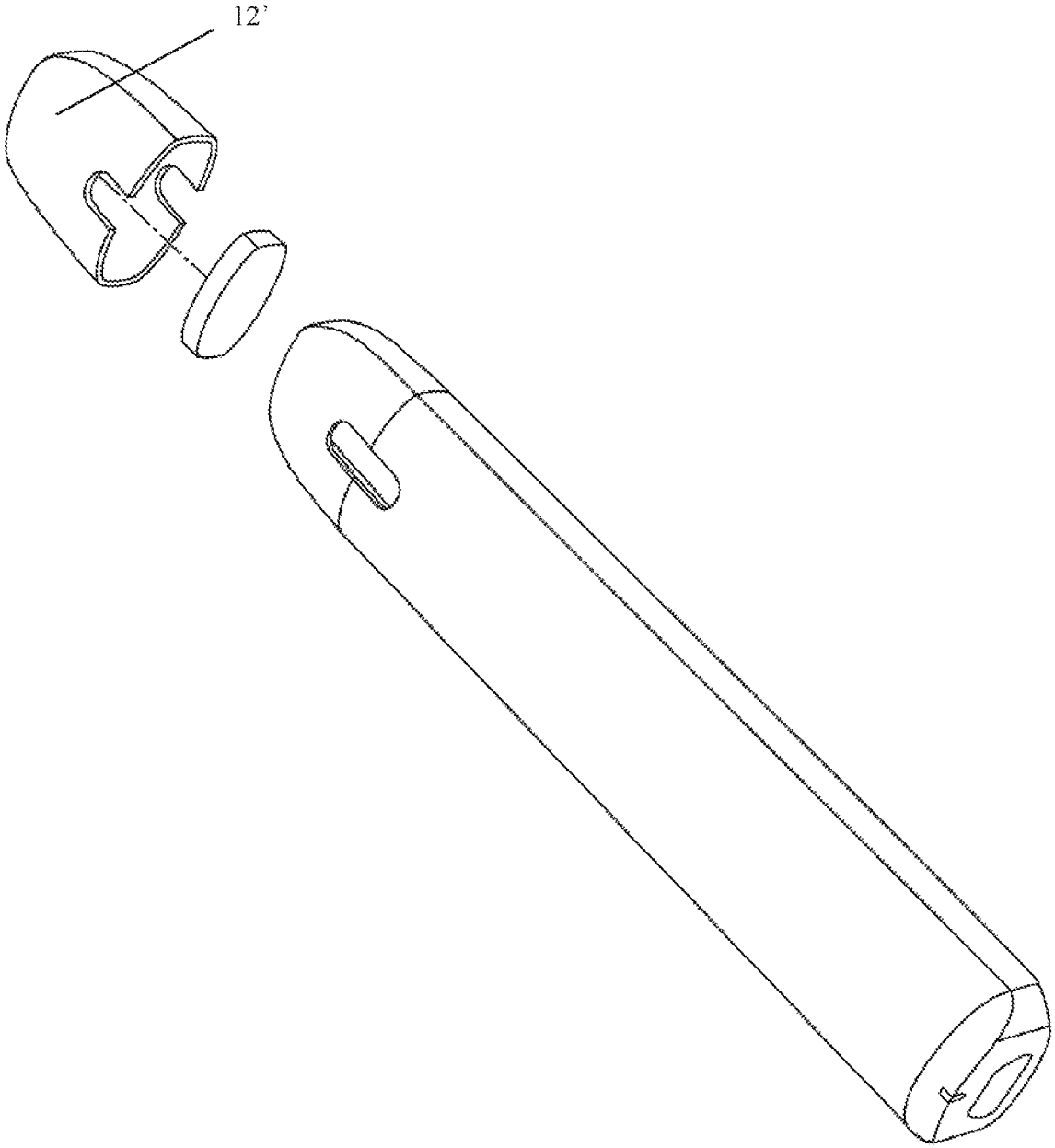
FIG. 11 is an exploded perspective view of a second type of electronic cigarette with a third alternative embodiment of the filtering unit of the present invention.
Figure 12:
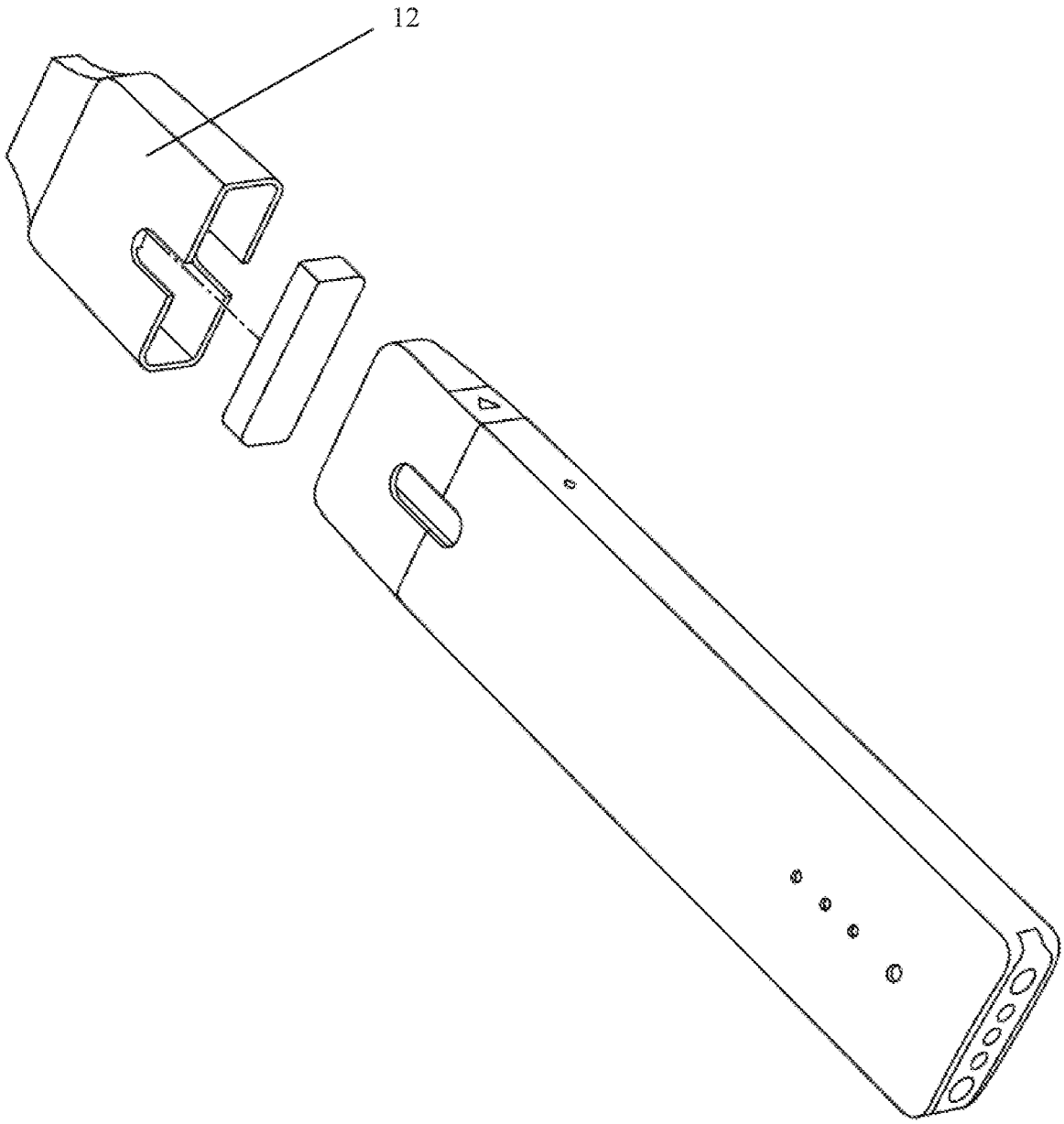
FIG. 12 is an exploded perspective view of a third type of electronic cigarette with a fourth alternative embodiment of the filtering unit of the present invention.
Figure 13:
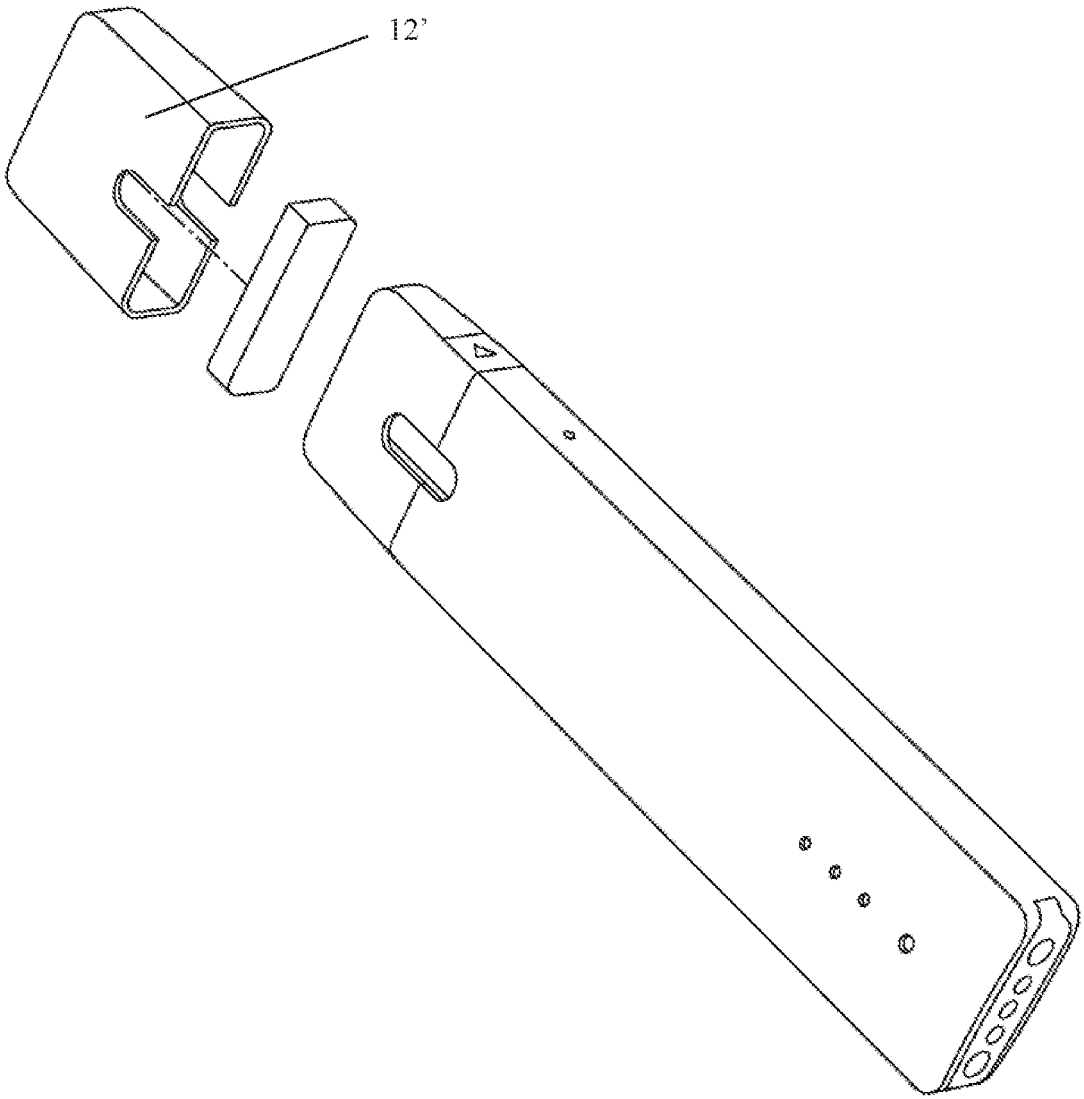
FIG. 13 is an exploded perspective view of a third type of electronic cigarette with a fifth alternative embodiment of the filtering unit of the present invention.

In use, the user will push the filtering unit 10, with the filter pad 38 already inserted therein, onto the pod unit 102 of the electronic cigarette until prongs 34 and 36 snap onto the upper portion of the pod unit, securely attaching the filtering unit with the inserted filter pad to the electronic cigarette. The electronic cigarette can then be used in a usual manner, as illustrated in FIG. 8. As shown in FIG. 9, the vapors heated by the charging unit pass through the filter pad 38 filtering out undesired particles and then into the user's mouth through the opening 20.

Figure 6:
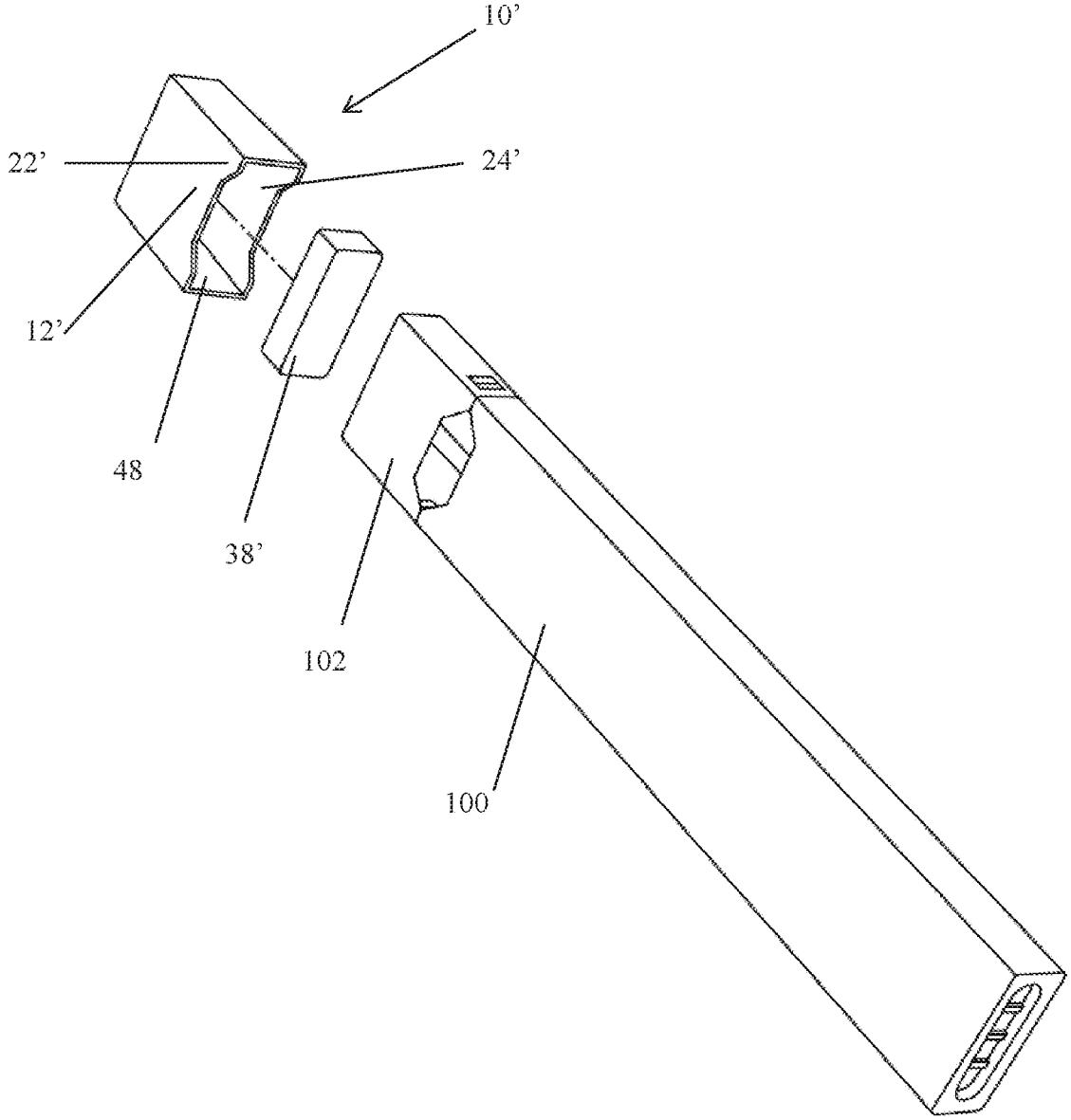
FIG. 6 is an exploded perspective view of a first type of electronic cigarette with an alternative embodiment of the filtering unit of the present invention.
Figure 7:
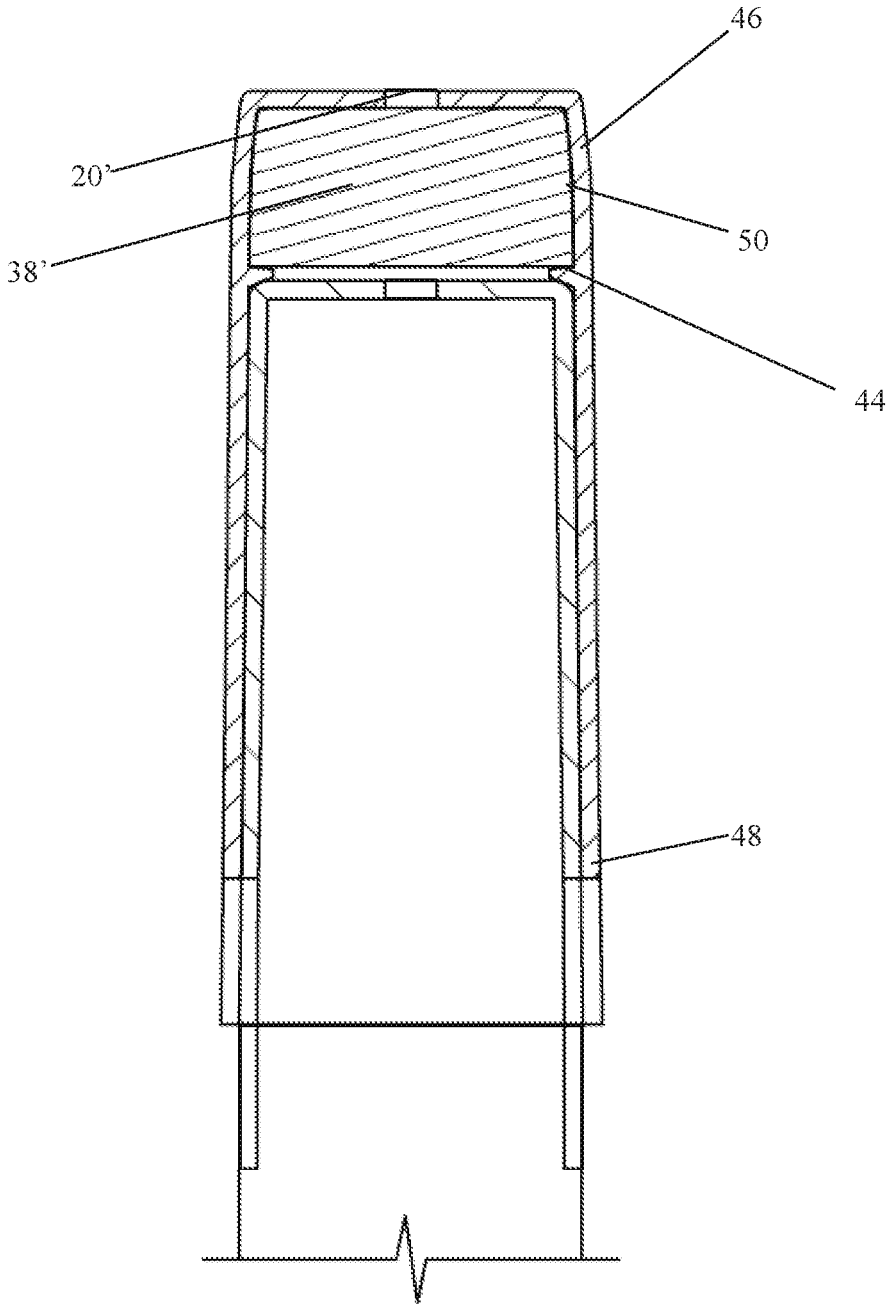
FIG. 7 is a cross-sectional view of the assembled first type of electronic cigarette with the alternative embodiment of the filtering unit of the present invention.

Another preferred embodiment of the filtering unit is illustrated in FIGS. 6-7. In this alternative embodiment, filtering unit 10' includes a hollow housing 12' having an upper portion 46 and a lower portion 48. The upper portion 46 includes a throughgoing opening 20' and one pair of internal prongs 44. Prongs 44 are positioned such that an internal chamber 50 is formed between the prongs 44 and the opening 20'. Chamber 50 is sized so as to accommodate the filter pad 38' positioned therein. Similarly to the first preferred embodiment, the lower portion 48 includes a front wall 22' and a rear wall 24'. However, in this alternative embodiment, walls 22' and 24' do not include any attachment prongs. The walls of the hollow housing 12' are simply pushed onto the upper part of the pod unit 102 so as to removably position the filtering unit 10' onto the electronic cigarette.

Figure 14:
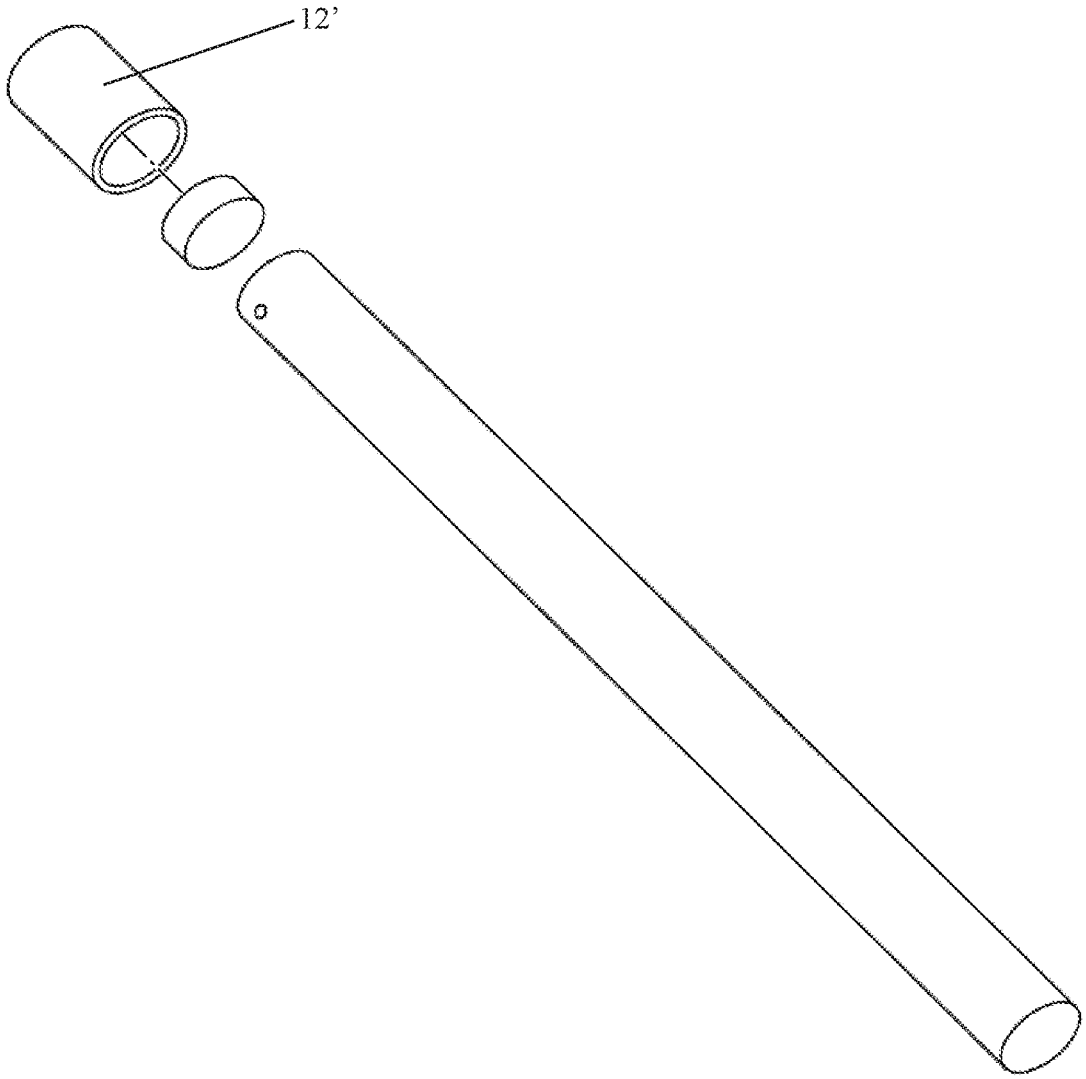
FIG. 14 is an exploded perspective view of a fourth type of electronic cigarette with a sixth alternative embodiment of the filtering unit of the present invention.

As shown in FIGS. 10-14, overall shape of the hollow housing 12 can vary depending on the shape of the pod unit 102 or the upper portion of a podless electronic cigarette (shown in FIG. 14).

It is empirically studied and concluded that the filtering unit 10 filters out undesired particles. The results of the empirical studies are recorded in Table 1 below. However, it should be understood by a person skilled in the art that the mechanism of the present invention is not limited to filtering out only the particles described below. Any other undesirable particles and chemicals produced by electronic cigarettes can be filtered out by the filtering unit 10 in the manner described in the present specification.

TABLE 1

| Analyte | Filtered Concentration (μg/pod) |
|---|---|
| Propylene Glycol | 4589.97 |
| Glycerin | 9169.03 |
| Benzoic acid | 1002.25 |

TABLE 1-continued

| Analyte | Filtered Concentration (μg/pod) |
|---|---|
| Triacetin | 23.55 |
| Nicotine | 2037.72 |
| Levomenthol | 115.53 |

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

We claim as follows:

1. A supplemental electronic cigarette filtering unit configured to externally attach to a mouthpiece end of an operable electronic cigarette having an internal filter, the filtering unit comprising:

a housing defining a first end, a second end opposite the first end, and an interior between the first end and the second end, wherein the housing is configured to operably engage with the mouthpiece end of the electronic cigarette and the interior of the housing is configured to receive therein at least a portion of a first mouthpiece of the electronic cigarette and a filtered vapor flow exiting from the portion of the first mouthpiece of the electronic cigarette; and one or more filter pads disposed within the interior of the housing, the one or more filter pads configured to be disposed downstream of the filtered vapor flow between the portion of the first mouthpiece of the electronic cigarette and the second end of the housing, the one or more filter pads being configured to further filter the filtered vapor flow.

2. The supplemental electronic cigarette filtering unit of claim 1, wherein the filtering unit is configured to permit the vapor flow into the interior and out the second end when exposed to a suction force applied by a user at an opening in the second end of the filtering unit.

3. The supplemental electronic cigarette filtering unit of claim 2, and wherein, in operation, the filtering unit is configured to reduce at least a nicotine content of the vapor flow from the electronic cigarette, and wherein the one or more filter pads are positioned within the interior such that at least a portion of the nicotine content of the vapor flow from the electronic cigarette is retained by the one or more filter pads within the filtering unit.

4. An assembly comprising:

an operable electronic cigarette comprising:

an internal filter; and a first mouthpiece disposed at a mouthpiece end of the electronic cigarette, wherein a vapor flow filtered by the internal filter is configured to exit the electronic cigarette via the first mouthpiece; and a supplemental filtering unit configured to externally attach to the mouthpiece end of the electronic cigarette, the supplemental filtering unit comprising:

a housing, the housing defining an interior configured to receive therein at least a portion of the first mouthpiece of the electronic cigarette and the filtered vapor flow exiting the electronic cigarette via the first mouthpiece; and one or more filter pads disposed within the interior of the housing, the one or more filter pads configured to be disposed downstream of the filtered vapor flow between the portion of the first mouthpiece of the electronic cigarette and the second end of the housing, the one or more filter pads being configured to further filter the filtered vapor flow.

5. The assembly of claim 4, wherein the interior of the housing is configured to interchangeably receive two or more types of electronic cigarettes.

6. The assembly of claim 4, wherein at least one of the one or more filter pads comprises treated cellulose acetate fiber.

7. The assembly of claim 4, wherein the housing comprises a proximal end operably engaged with the electronic cigarette and a distal end opposite the proximal end.

8. The assembly of claim 7, wherein an external surface of the housing defines a second mouthpiece at the distal end of the supplemental filtering unit.

9. The assembly of claim 4, wherein, in operation, the supplemental filtering unit is configured to reduce at least a nicotine content of the filtered vapor flow from the electronic cigarette.

10. The assembly of claim 9, wherein the one or more filter pads are positioned within the interior such that at least a portion of the nicotine content of the filtered vapor flow from the electronic cigarette is retained by the one or more filter pads within the supplemental filtering unit.

11. The assembly of claim 4, wherein, in operation, the assembly is configured to direct the vapor flow through both the internal filter of the electronic cigarette and the one or more filter pads of the supplemental filtering unit before being inhaled by a user of the assembly.

12. The assembly of claim 4, wherein the mouthpiece end of the electronic cigarette comprises a pod unit.

13. The assembly of claim 4, wherein an internal surface of the housing of the supplemental filtering unit comprises one or more internal prongs configured to removably engage the one or more filter pads within the interior of the housing.

14. The assembly of claim 4, wherein the housing of the supplemental filtering unit further comprises one or more attachment prongs located proximate a proximal end of the housing and extending towards an interior of the housing, the attachment prongs sized and configured to attach the proximal end of the housing over at least a portion of the first mouthpiece of the electronic cigarette.

15. The assembly of claim 14, wherein the one or more attachment prongs are structured to permanently attach to the electronic cigarette.

16. The assembly of claim 14, wherein the one or more attachment prongs are structured to removably attach to the electronic cigarette.

17. A method of attaching a supplemental electronic cigarette filtering unit to a an operable electronic cigarette, the method comprising:

externally attaching the supplemental filtering unit over a first mouthpiece of an operable electronic cigarette, wherein the electronic cigarette comprises an internal filter, and wherein the supplemental filtering unit comprises:

a housing defining a first end, a second end opposite the first end, and an interior between the first end and the second end, wherein the housing is configured to operably engage with the first mouthpiece of the electronic cigarette and the interior of the housing is configured to receive therein at least a portion of the first mouthpiece of the electronic cigarette and a filtered vapor flow exiting from the first mouthpiece of the electronic cigarette; and one or more filter pads disposed within the interior of the housing, the one or more filter pads configured to be disposed downstream of the filtered vapor flow between the portion of the first mouthpiece of the electronic cigarette and the second end of the housing, the one or more filter pads being configured to further filter the filtered vapor flow.

18. The method of claim 17, wherein the interior of the housing of the supplemental electronic cigarette filtering unit is configured to interchangeably receive two or more types of electronic cigarettes.

19. The method of claim 17, further comprising:

causing the filtered air flow to enter into the interior of the housing from the electronic cigarette and exit out of the second end by applying a suction force at an opening defined by the second end of the supplemental filtering unit.

20. The method of claim 19, further comprising:

causing at least a portion of an air flow to flow through the internal filter to form the filtered air flow; and causing at least a portion of the filtered air flow to flow through the one or more filter pads of the supplemental filtering unit such that at least a nicotine content of the filtered vapor flow is reduced between exiting the first mouthpiece of the electronic cigarette and the second end of the supplemental filtering unit.

* * * * *